US010683995B1

(12) United States Patent
Hashimoto

(10) Patent No.: US 10,683,995 B1
(45) Date of Patent: Jun. 16, 2020

(54) LIGHTING APPARATUS

(71) Applicant: SGF Associates, Inc., New York, NY (US)

(72) Inventor: Yasuki Hashimoto, New York, NY (US)

( * ) Notice: Subject to any disclaimer, the term of this patent is extended or adjusted under 35 U.S.C. 154(b) by 0 days.

(21) Appl. No.: 16/224,202

(22) Filed: Dec. 18, 2018

(51) Int. Cl.

| | |
|---|---|
| ***F21V 21/04*** | (2006.01) |
| ***F21V 21/30*** | (2006.01) |
| ***F21V 1/02*** | (2006.01) |
| ***F21V 3/02*** | (2006.01) |
| ***F21S 8/02*** | (2006.01) |
| ***F21Y 115/10*** | (2016.01) |

(52) U.S. Cl.
CPC ..... *F21V 21/043* (2013.01); *F21S 8/02* (2013.01); *F21V 1/02* (2013.01); *F21V 3/02* (2013.01); *F21V 21/30* (2013.01); *F21Y 2115/10* (2016.08)

(58) Field of Classification Search
None
See application file for complete search history.

(56) References Cited

U.S. PATENT DOCUMENTS 1,962,547 A * 6/1934 Zerk ..... F16M 11/16 248/188.8
5,388,825 A * 2/1995 Myers ..... A63B 43/06 473/570
6,076,946 A * 6/2000 Brouillette, III ..... F21V 15/01 362/183
6,155,700 A * 12/2000 Hsu ..... A63H 17/28 362/196
7,040,783 B1 * 5/2006 Christianson ..... F21L 4/04 362/186
7,959,330 B2 * 6/2011 Hashimoto ..... F21K 9/00 362/294
8,356,920 B2 * 1/2013 Levine ..... F21S 8/00 362/249.03
8,408,736 B2 * 4/2013 Chien ..... H04N 5/2354 362/235
8,662,718 B2 * 3/2014 Hashimoto ..... F21S 8/03 362/373
10,004,569 B2 * 6/2018 Singh ..... A61B 90/10
2001/0055486 A1 * 12/2001 Visram ..... F16M 13/02 396/419
2014/0151247 A1 * 6/2014 Rolf ..... A61B 46/10 206/37

* cited by examiner

*Primary Examiner* — Britt D Hanley
(74) *Attorney, Agent, or Firm* — K&L Gates LLP

(57) ABSTRACT

A lighting apparatus includes: a lighting fixture body having a light source; and a supporting tool for supporting the lighting fixture body, wherein the lighting fixture body has a spherical portion, the supporting tool includes a first receiving portion, a second receiving portion, and an arm for fixing the first receiving portion and the second receiving portion, the arm has a shape in which a spherical portion of the lighting fixture body is sandwiched and supported between the first receiving portion and the second receiving portion, and the lighting fixture body and the first receiving portion are not supported by a shaft and the lighting fixture body and the second receiving portion are not supported by the shaft.

4 Claims, 11 Drawing Sheets

LIGHTING APPARATUS

BACKGROUND

Technical Field

The present invention relates to a lighting apparatus including a lighting fixture body having a light source and a supporting tool for supporting the lighting fixture body.

Related Art

As a lighting apparatus including a lighting fixture body and a supporting tool, for example, a lighting apparatus disclosed in the following JP 2017-149242 A or JP 2014-143103 A is already known.

The lighting apparatus disclosed in JP 2017-149242 A includes a light source container which stores a light emitting element, and a power supply container which is disposed on a back side of the light source container. The power supply container is supported by a support arm. The support arm and the power supply container are screwed by a bolt. The support arm is screwed to an installation surface of the lighting apparatus by the bolt.

The lighting apparatus disclosed in JP 2014-143103 A includes an annular first frame body, an annular second frame body, and a lighting fixture body. As shown in FIG. 2 of the JP 2014-143103 A, the lighting fixture body is pivotally supported to the first frame body, and is rotated in a vertical direction. The annular first frame body is enclosed in the annular second frame body fixed to a ceiling or the like while being slidable, and can be rotated 360° in a horizontal direction.

SUMMARY

In the lighting apparatus of JP 2017-149242 A, a screw for fixing the support arm and the power supply container is defined as a first shaft, and a screw for fixing the support arm and a ground surface is defined as a second shaft. In the lighting apparatus of JP 2017-149242 A, the lighting apparatus is rotated in the horizontal direction by rotating the power supply container with respect to the second shaft, and the lighting apparatus is rotated in the vertical direction by rotating the lighting apparatus with respect to the first shaft. The lighting apparatus is configured to irradiate light in a desired direction by combining the rotation of the first shaft with the rotation of the second shaft.

In the lighting apparatus of JP 2014-143103 A, a shaft which rotatably supports the lighting fixture body and the first frame body is defined as a first shaft. The lighting apparatus is rotated in the vertical direction by rotating the lighting apparatus with respect to the first shaft. The lighting apparatus has the second frame body which rotatably supports the first frame body in the horizontal direction. The lighting apparatus is rotated in the horizontal direction by rotating the first frame body with respect to the second frame body. The lighting apparatus is configured to irradiate light in a desired direction by combining the rotation of the first shaft with the rotation of the first frame body and the rotation of the second frame body.

The directions of both the lighting apparatus of JP 2017-149242 A and the lighting apparatus of JP 2014-143103 A are changed by combining the rotation in the horizontal direction with the rotation in the vertical direction. In such a lighting apparatus, since the direction of the lighting apparatus is changed by combining the two operations in the horizontal direction and the vertical direction, the operation at the time of changing the direction of the lighting apparatus cannot help but be awkward.

In view of the above problems, it is an object of the present invention to provide a lighting apparatus capable of smoothly changing a direction of the lighting apparatus.

A lighting apparatus includes: a lighting fixture body having a light source; and a supporting tool for supporting the lighting fixture body, wherein the lighting fixture body has a spherical portion, the supporting tool includes a first receiving portion, a second receiving portion, and an arm for fixing the first receiving portion and the second receiving portion, the arm has a shape in which the spherical portion of the lighting fixture body is sandwiched and supported between the first receiving portion and the second receiving portion, and the lighting fixture body and the first receiving portion are not supported by a shaft and the lighting fixture body and the second receiving portion are not supported by a shaft.

The above lighting apparatus has a structure in which the lighting fixture body has the spherical portion and the spherical portion is gripped and supported by the first receiving portion and the second receiving portion. Therefore, the direction of the lighting fixture body can be freely changed by rotating the spherical portion of the lighting fixture body in an arbitrary direction with respect to the first receiving portion and the second receiving portion by sliding.

In the above lighting apparatus, it is preferable that a plurality of concave grooves is provided on a circumferential surface of the spherical portion of the lighting fixture body. It is possible to increase a surface area of the spherical portion by providing the concave groove on the circumferential surface of the spherical portion. That is, there is no need to provide a separate radiating fin by providing a function of the radiating fin on the spherical portion. Accordingly, it is possible to reduce a size of the lighting apparatus.

In the lighting apparatus described above, it is preferable that the first receiving portion or the second receiving portion is configured to be in sliding contact with the spherical portion of the lighting fixture body and rotatably support the spherical portion. Accordingly, it is possible to stably support the spherical portion of the lighting fixture body.

In the lighting apparatus described above, it is preferable that the first receiving portion or the second receiving portion includes a screw that can be displaced in a direction approaching or moving away from the spherical portion to adjust a frictional resistance to the spherical portion. It is possible to change the resistance when the spherical portion rotates by bringing the screw close to the spherical portion or move the screw away from the spherical portion.

According to the present invention, it is possible to provide a lighting apparatus that can smoothly change a direction of the lighting apparatus.

DETAILED DESCRIPTION

Hereinafter, as embodiments of a lighting apparatus, a lighting apparatus 1 according to a first embodiment, a lighting apparatus 1*b* according to a second embodiment, and a lighting apparatus 1*c* according to a third embodiment will be described with reference to the accompanying drawings.

First Embodiment

Figure 1:
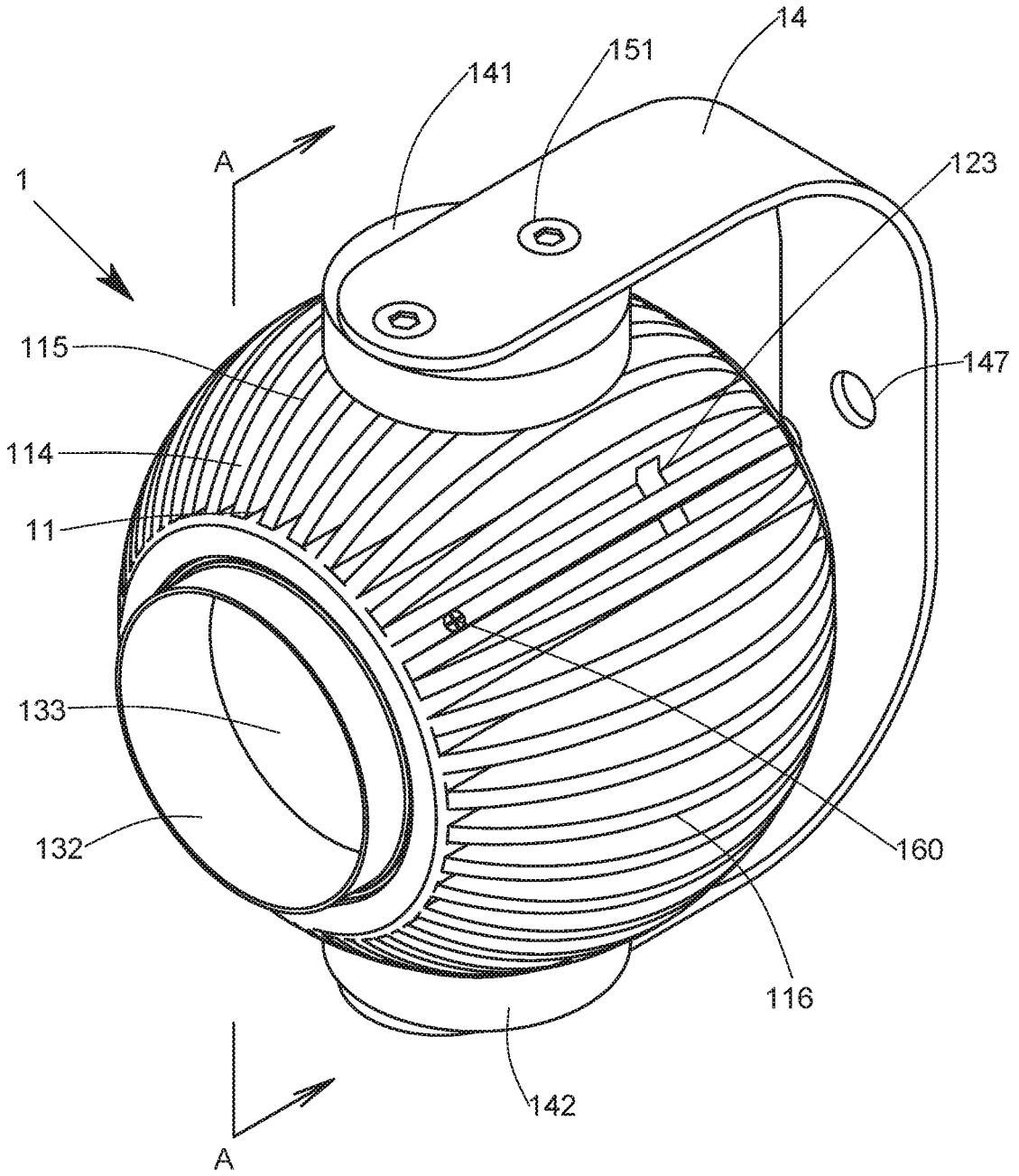
FIG. 1 is a perspective view showing a lighting apparatus according to a first embodiment.
Figure 2:
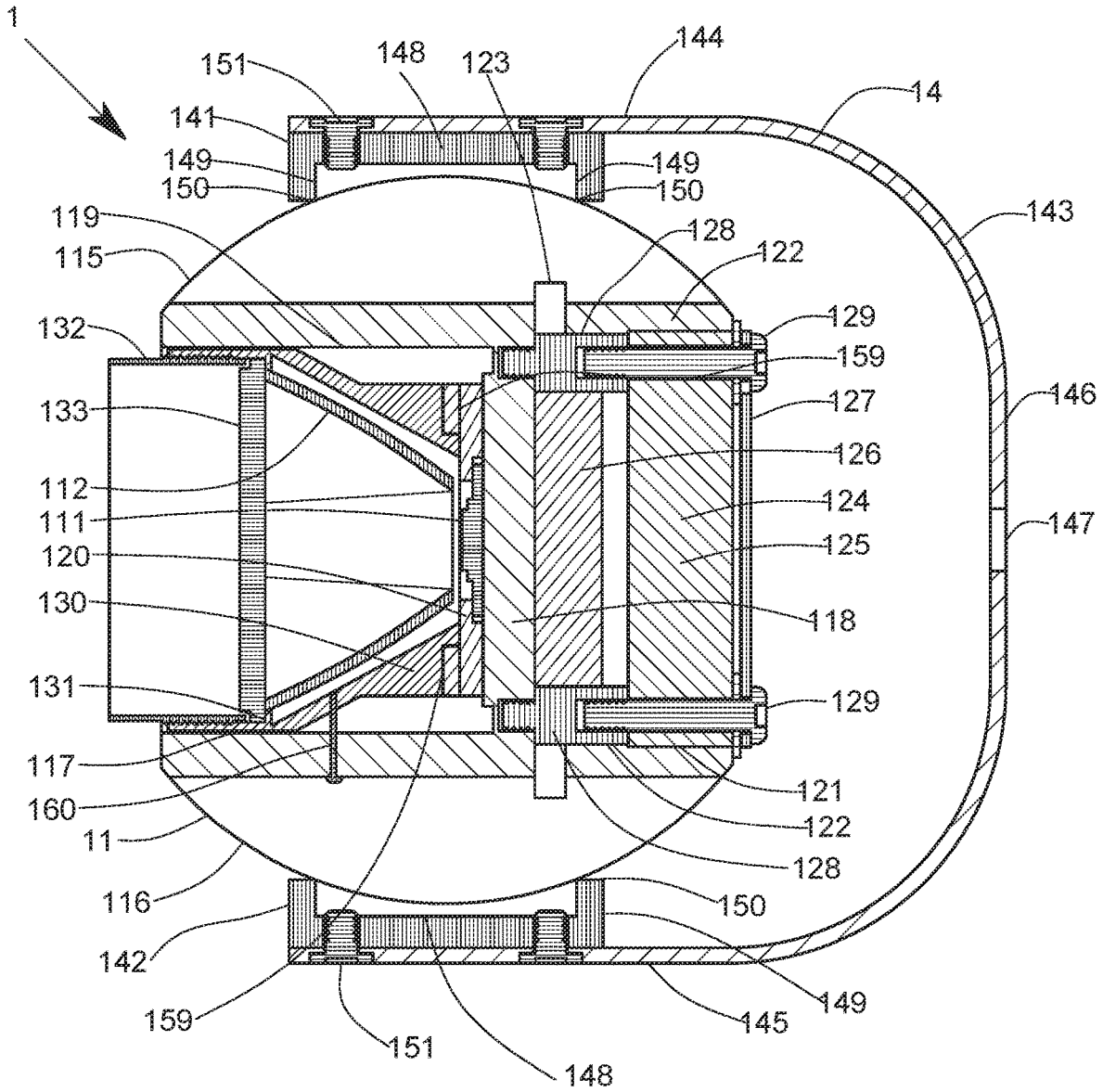
FIG. 2 is a cross-sectional view of a portion A in FIG. 1.

As shown in FIGS. 1 and 2, a lighting apparatus 1 according to a first embodiment includes a lighting fixture body 11 and a supporting tool 14 for supporting the lighting fixture body 11. First, a configuration of the lighting fixture body 11 will be described, and then a configuration of the supporting tool 14 will be described.

[Lighting Fixture Body]

The lighting fixture body may include a light source and a spherical portion for supporting the lighting fixture body. As shown in FIG. 2, the lighting fixture body 11 of FIGS. 1 and 2 includes an LED element 111 as a light source, a reflecting mirror 112 for reflecting light irradiated from the LED element 111, and a lens 133 fixed to an end portion of the reflecting mirror 112. In the example of FIG. 2, as the LED element 111, a chip on board LED (COD LED) in which an LED element is directly mounted on a board is used. As the reflecting mirror 112, a truncated cone-like tube having an opening installed at one end and the other end is used. An inner surface of the tube becomes a reflection surface by vapor deposition or the like of metal, and reflects incident light. The lens 133 is arranged to condense the light incident from the reflecting mirror 112 or the LED element 111 so as to illuminate a desired range. In the example of FIGS. 1 and 2, the light source is built in the spherical portion.

The spherical portion is sandwiched and supported between a first receiving portion and a second receiving portion of a supporting tool to be described below, and may have a shape suitable for rotation, and a specific shape thereof is not limited to a true sphere. In the lighting fixture body 11 of FIGS. 1 and 2, almost the entire part becomes a spherical portion 116 except for a front part irradiating light and a back part positioned on an opposite side of the front part. As shown in FIG. 1, a plurality of concave grooves 114 extending in a direction (hereinafter, referred to as a front and back direction) from the front part toward the back part has a shape in which the concave grooves 114 extend in parallel to each other on a circumferential surface of the spherical portion 116. A part where the concave groove 114 is not provided becomes a plurality of projections 115 extending in the front and back direction. That is, the concave groove 114 and the projection 115 are alternately arranged to each other. As shown in FIG. 2, each projection 115 is a substantially arc shape in a cross section taken along the front and back direction. An appearance of the lighting fixture body 11 is formed in a substantially spherical shape by tip portions of the plurality of projections 115. That is, a substantially spherical housing of the lighting fixture body 11 in which the light source is built is constituted by the plurality of projections 115.

As shown in FIG. 2, the spherical portion 116 is provided with a concave hole 117 recessed toward the back part. The concave hole 117 is circular when viewed from the front and has a cylindrical shape. The concave hole 117 is a space surrounded by a bottom wall 118 and a side wall 119 disposed in a circle when viewed from the front. The lens 133, the reflecting mirror 112, and the LED element 111 described above are accommodated in this space. Specifically, the LED element 111 is arranged so as to be in contact with the bottom wall 118, and the LED element 111 is fixed to the bottom wall 118 by a fixture 120. The fixture 120 is an annular plate having a through hole provided on a center thereof when viewed from the front. The LED element 111 is arranged between the fixture 120 and the bottom wall 118 in a state where the LED element 111 is exposed from the through hole, and the fixture 120 and the bottom wall 118 are connected to each other by a screw. The bottom wall 118, the side wall 119, and the plurality of projections 115 are integrally molded and are made of a metal such as aluminum. Therefore, heat generated from the LED element 111 is diffused into the atmosphere through the bottom wall 118, the side wall 119, and the plurality of projections 115. In this way, the bottom wall 118 and the side wall 119 function as a heat sink, and the plurality of projections 115 functions as radiating fins.

As shown in FIG. 2, a support member 130 for supporting the lens 133 and the reflecting mirror 112 is fitted in the concave hole 117. The support member 130 is a cylindrical body having a dimension which can enclose the reflecting mirror, and a base end portion is in contact with the fixture 120 of the LED element 111, and a tip portion is provided with a protrusion 131 for supporting the lens 133 and the reflecting mirror. The protrusion 131 has a flange shape disposed on an inner circumferential surface of the support member 130. The reflecting mirror 112 is supported so that an outer circumferential portion of the tip portion is in contact with a tip of the protrusion 131. The protrusion 131 has a flange shape protruding radially inward. The lens is disposed on the protrusion 131 to be supported. The support member 130 has a screw portion for fixing a cylindrical body 132 on an inner circumferential surface of the tip portion from the tip than on the protrusion 131. By screwing the corresponding screw portion provided on an outer circumferential surface of the cylindrical body 132 with the screw portion of the support member 130, the lens 133 is restrained at a lower end portion of the cylindrical body 132, and the support member 130, the reflecting mirror 112, and the lens 133 are integrated.

A permanent magnet 159 for detachably fixing the fixture 120 and the support member 130 is disposed between the fixture 120 and the support member 130. In the first embodiment, a neodymium magnet is used as the permanent magnet. The support member 130 is provided with a recess for accommodating the permanent magnet 159. The permanent magnet in the recess is fixed by an appropriate means such as an adhesive or a screw fastener. Since the fixture is made of a magnetic material such as iron, it is possible to detachably fix a member including the support member 130 provided with the permanent magnet 159.

In the lighting apparatus 1 according to the first embodiment, a screw 160 is screwed into a screw hole through which the support member 130 communicates with the side wall 119. As described above, the support member 130 and the fixture 120 are detachably fixed by the permanent magnet 159. In the fixing by a magnetic force, there is a possibility that the member including the support member 130 is unintentionally separated due to an external force. Therefore, the support member 130 is prevented from being unintentionally separated by the screw 160 described above.

As shown in FIG. 2, a circular concave hole 121 is also provided on a back part of the spherical portion 116 when viewed from the back. The concave hole 121 is also a cylindrical hole. The bottom wall 118 is in common with the circular concave hole 117 provided on the front part. The concave hole 121 on the back part becomes a space surrounded by side walls 122 disposed in a circle when viewed from the back. As a waste heat device 124, a fan and a driving unit 125, a substrate 126 for controlling the fan and the driving unit, and a cover 127 are stored in this space. The driving unit is a small motor, and the driving unit and the fan are unitized.

As shown in FIG. 2, the substrate 126 is sandwiched and supported between a pair of first screws 128 screwed to the bottom wall 118. The fan, the driving unit 125, and the cover 127 are mounted on the first screw 128, and the second screw 129 is screwed into the screw hole provided on an upper end portion of the first screw 128 to fix the fan, the driving unit 125, and the cover 127 to the concave hole 121 on the back part.

The side wall 122 of the concave hole 121 on the back side is integrally molded with the side wall 119, the bottom wall 118, and the plurality of projections 115 of the concave hole 117 on the front side. The base end portions of the plurality of projections 115 have a shape protruding toward an outer side of a sphere from the side wall 119 of the concave hole on the front side and the side wall 122 of the concave hole on the back side. Vent holes 123 penetrating through the side wall 122 are provided along an inner circumferential surface of the side wall 122 of the concave hole 121 on the back side. The vent hole 123 allows the concave hole 121 on the back part to communicate with a space between the plurality of projections 115. Therefore, when the waste heat device 124 is operated, outside air forcibly taken in from the back part comes into contact with the bottom wall 118 and the side wall 122 to exchange heat. The heated air passes through the vent holes 123 and is further discharged to the outside of the lighting apparatus 1 while absorbing the heat of the side wall 119 and the plurality of projections 115. In the lighting apparatus 1 according to the first embodiment, the light source, a member related to the light source, and the waste heat device are built in the spherical portion 116, and the spherical portion functions as the radiating fin, and therefore the lighting apparatus 1 has a compact structure.

The configuration of the light source or a method for fixing a light source is not limited to the above examples, and for example, as a light emitting element, a surface-mounted LED (SMD type LED) may be used or an incandescent lamp may be used, and the reflecting mirror, the support member, the fixture, and the like may be omitted or the configuration thereof may be changed. In addition, for example, a plurality of lenses may be used. In addition, the presence or absence of the waste heat device, the presence or absence of the vent hole, and the specific constitution thereof are also not particularly limited. For example, the waste heat device, the concave hole 121 on the back part for installing the same, or the vent hole or the like may be omitted.

[Supporting Tool]

The supporting tool includes the first receiving portion, the second receiving portion, and the arm for fixing the first receiving portion and the second receiving portion, and the arm may have any shape as long as it supports the spherical portion of the lighting fixture body by sandwiching the spherical portion of the lighting fixture body between the first receiving portion and the second receiving portion.

In the first embodiment, as shown in FIG. 2, the supporting tool 14 includes a first receiving portion 141, a second receiving portion 142, and an arm 143 for fixing the first receiving portion 141 and the second receiving portion 142, and the arm 143 is shaped to support the spherical portion 116 of the lighting fixture body 11 by sandwiching the spherical portion 116 of the lighting fixture body 11 between the first receiving portion 141 and the second receiving portion 142.

As shown in FIG. 2, the spherical portion 116 of the lighting fixture body 11 and the first receiving portion 141 are not supported by a shaft or the like, and similarly, the spherical portion 116 of the lighting fixture body 11 and the second receiving portion 142 are not supported by a shaft or the like. The spherical portion 116 is sandwiched between the first receiving portion 141 and the second receiving portion 142 to be in the supported state.

Figure 4:
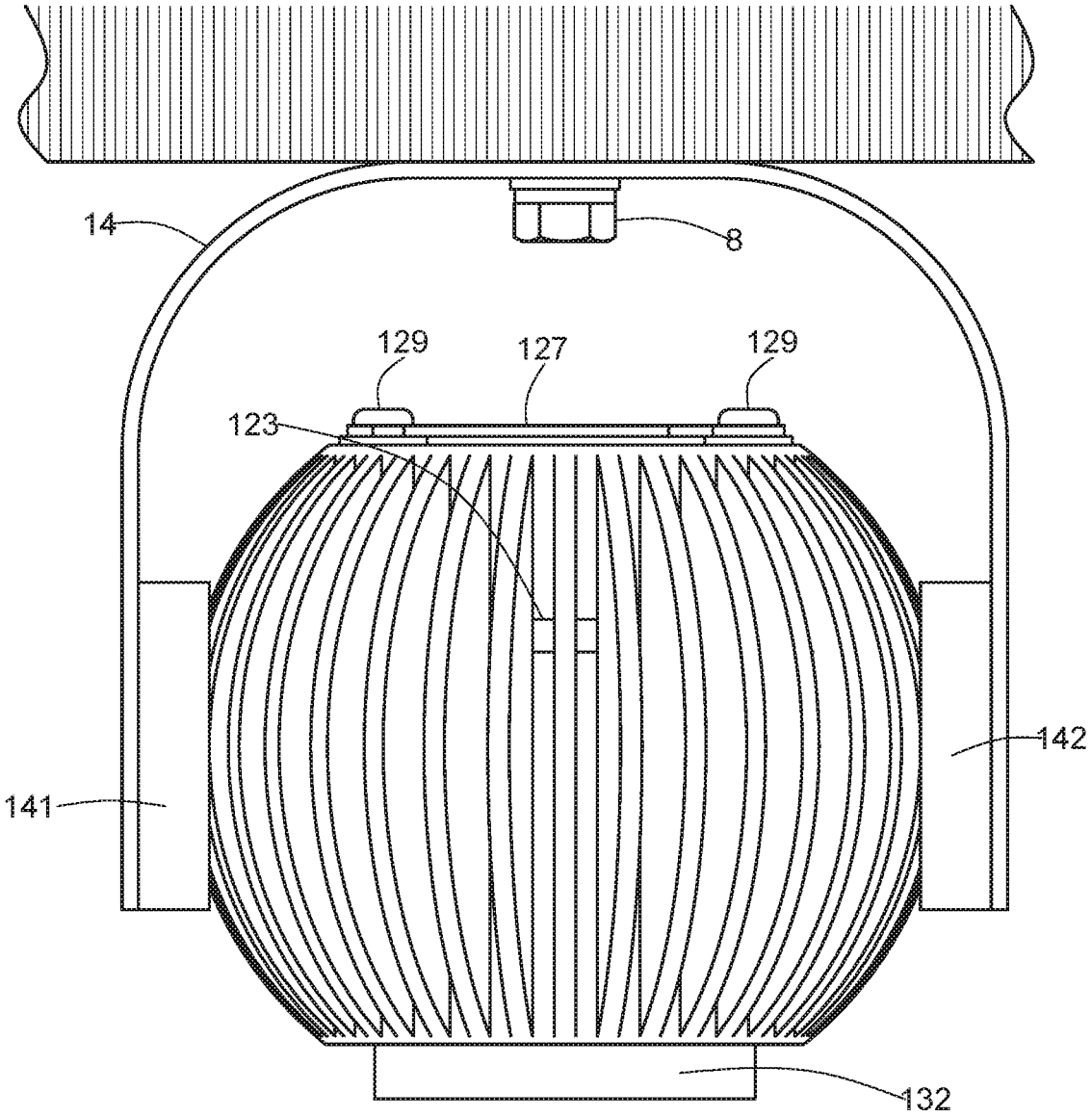
FIG. 4 is a diagram showing a state in which the lighting apparatus of FIG. 1 is attached.

The arm 143 may have any shape as long as it can sandwich the spherical portion between the first receiving portion and the second receiving portion. The arm 143 of the first embodiment is formed of a metal plate which is a single rigid body in which the first receiving portion 141 and the second receiving portion 142 are provided on an inner side of the tip portion. The metal plate includes a first arm 144 and a second arm 145 which are disposed at intervals enough to enclose the spherical portion, and a base portion 146 connecting between an end portion of the first arm 144 and an end portion of the second arm 145. A connection portion between the base portion 146 and the first arm 144 or the second arm 145 has a round shape. The arm 143 is configured in a U shape as a whole. The first receiving portion 141 and the second receiving portion 142 are each disposed inside the tip portions of the first arm 144 and the second arm 145. A through hole 147 is disposed in the middle of the base portion 146. When the supporting tool 14 is fixed to a structure such as a wall or a ceiling, as shown in FIG. 4, it is possible to fix the lighting apparatus 1 to the wall or the ceiling by inserting a screw 8 through the through hole 147. Although not shown in FIG. 4, the lighting apparatus 1 may be fixed to a ceiling or a wall via a member having a rail for fixing the arm 143 of the lighting apparatus 1. In addition, although not shown in FIG. 4, cords for supplying power may be connected to the lighting apparatus.

The arm has rigidity to support the spherical portion by sandwiching the spherical portion between the first receiving portion and the second receiving portion, and when pushing the spherical portion between the first receiving portion and the second receiving portion, the arm is deformed to widen the interval between the first receiving portion and the second receiving portion and is preferably made of a material having elasticity enough to return to an original shape after fitting the spherical portion. For example, the arm may be made of metal or plastic having a fixed form and elastically deformed properties. It is preferable that the arm is formed by bending a plate material, for example.

Figure 3:
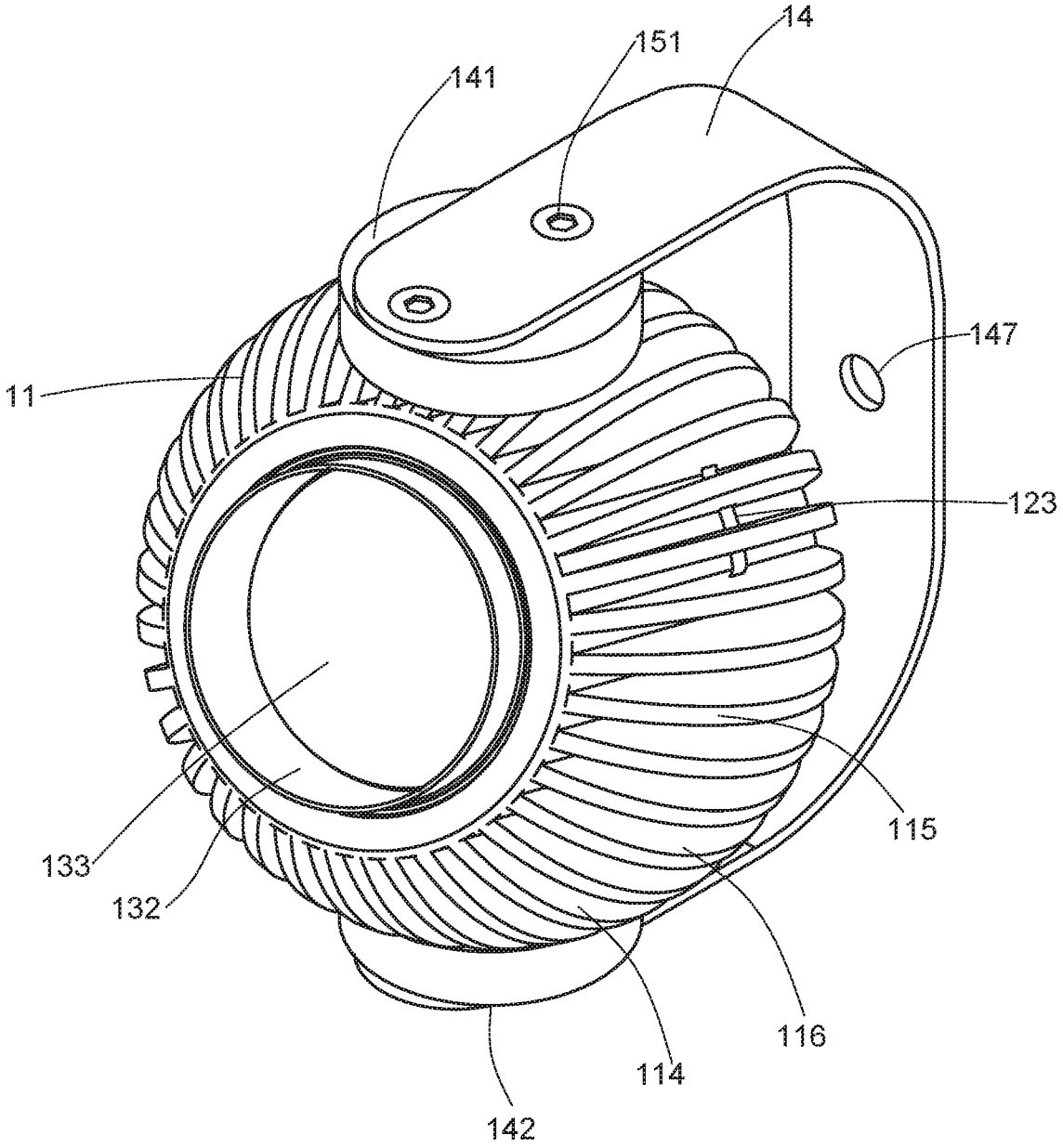
FIG. 3 is a perspective view showing a state in which a lighting fixture body of the lighting apparatus of FIG. 1 is rotated.

Any first receiving portion and second receiving portion may be used as long as the first receiving portion and the second receiving portion can sandwich and support the spherical portion. In the example of FIG. 2, the first receiving portion 141 and the second receiving portion 142 are formed of a cup which is in sliding contact with the spherical portion 116. As shown in FIG. 2, the cup has a base portion 148 made of a circular plate material and a circular edge 149 protruding from the base portion 148 toward the inner side of the supporting tool 14. The edge 149 of the cup is circular and constitutes an annular portion 150. Since the annular portion 150 is in linear contact with the spherical portion 116, it is possible to freely change the direction of the spherical portion 116 by making the spherical portion 116 slide against the annular portion 150 with a relatively small force. As a result, as shown in FIG. 3, the lighting fixture body 11 can be freely rotated with respect to the fixed supporting tool 14.

The supporting tool 14 and the lighting fixture body 11 are not fixed by the shaft but fixed by the sliding, and therefore can be smoothly rotated in all directions. Since the annular portion is in line contact with the spherical portion, the contact area with the spherical portion 116 is small, such that it is possible to rotate the spherical portion 116 with a relatively small force. Since the plurality of concave grooves 114 is provided in the spherical portion 116, it is possible to obtain a smoother operation feeling by reducing the contact area of the spherical portion 116 and the first receiving portion 141. In addition, since the plurality of concave grooves 114 functions as the radiating fin, it is not necessary to provide a separate radiating fin, so that the size of the lighting apparatus can be reduced.

In the example of FIG. 2, the first receiving portion 141 is made of plastic, and the first arm 144 and the base portion 148 are fixed by a plurality of screws 151 in a state in which the base portion 148 is in surface contact with the first arm 144. The second receiving portion 142 is also made of plastic, and the second arm 145 and the base portion 148 are fixed by the plurality of screws 151 in a state in which the base portion 148 is in surface contact with the second arm 145.

Figure 11:
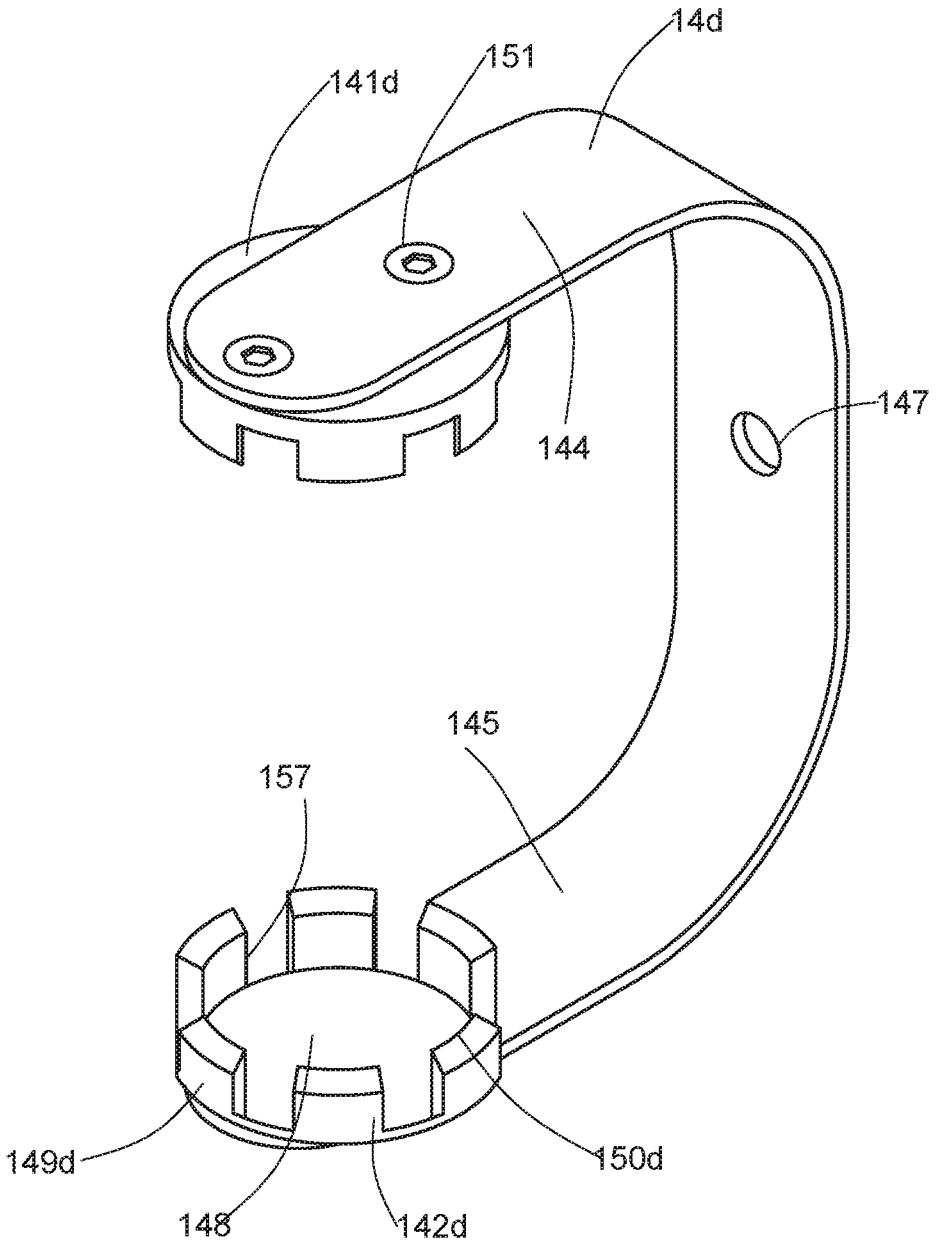
FIG. 11 is a perspective view showing another example of a first receiving portion and a second receiving portion.

The configurations of the first receiving portion and the second receiving portion are not limited to the configuration of FIG. 2, but may be, for example, a pad having a spherical surface curved along the appearance of the spherical portion. In addition, as shown in FIG. 11, the configuration of the arm 14*d* may be changed so as to include a first receiving portion 141*d* and a second receiving portion 142*d*. In the example of FIG. 11, a notch 157 is provided intermittently on a circular edge 149*d*, and an annular portion 150*d* is divided into lines along a plurality of spherical portions 116. The same reference numerals as in FIG. 1 are used for components common to the arm 14 in FIG. 1.

Second Embodiment

Figure 5:
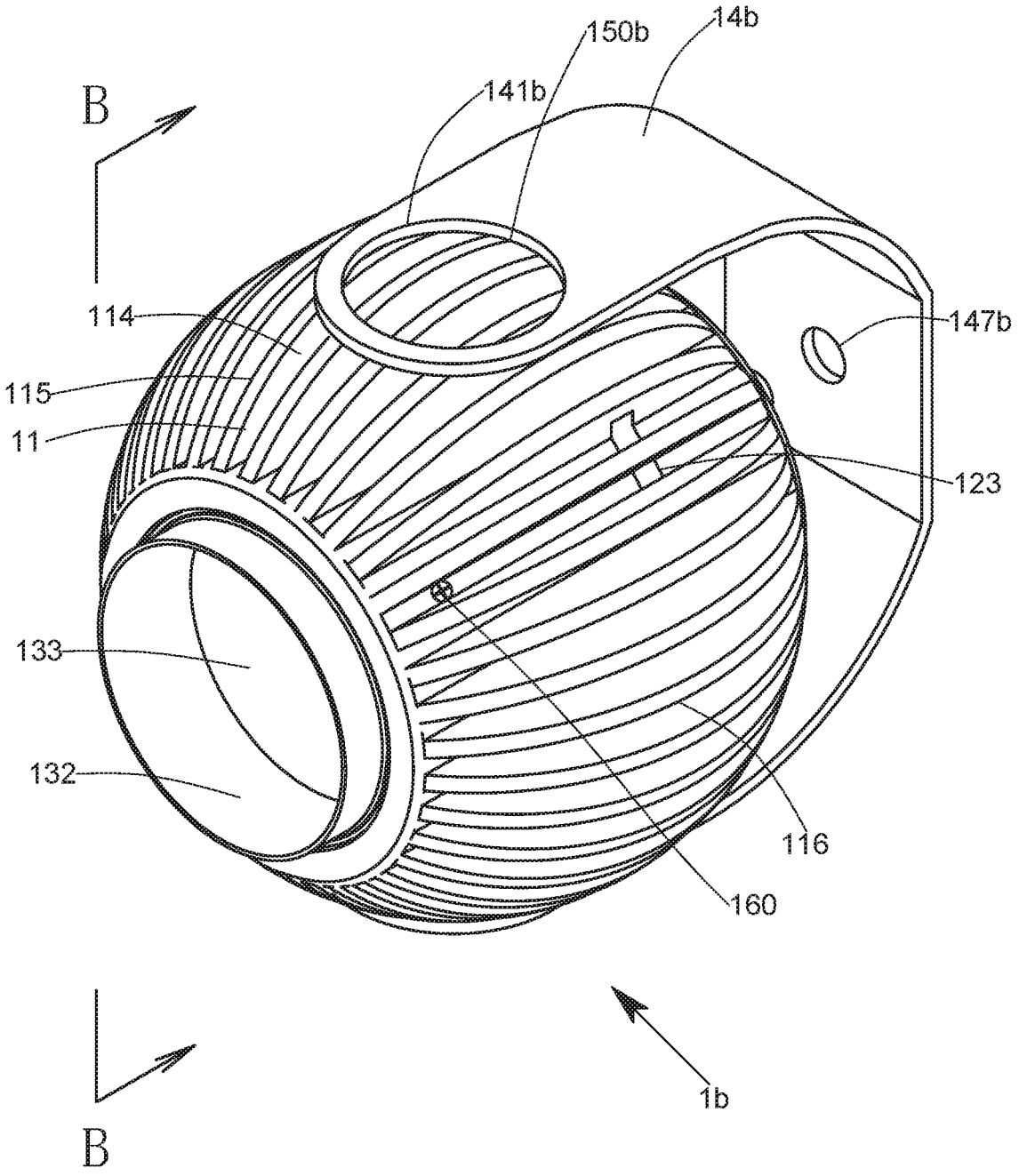
FIG. 5 is a perspective view showing a lighting apparatus according to a second embodiment.
Figure 6:
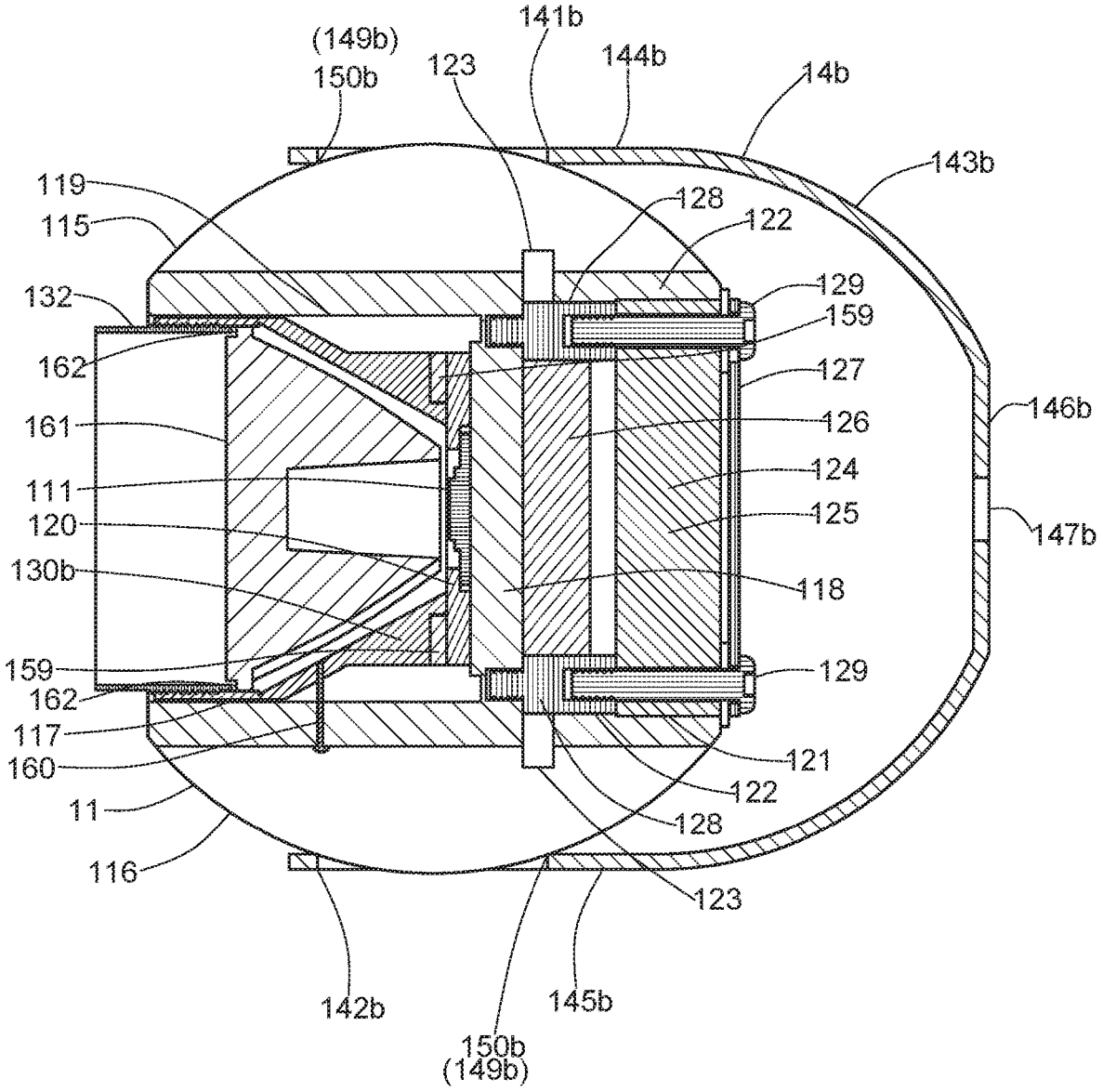
FIG. 6 is a cross-sectional view of a portion B in FIG. 5.
Figure 7:
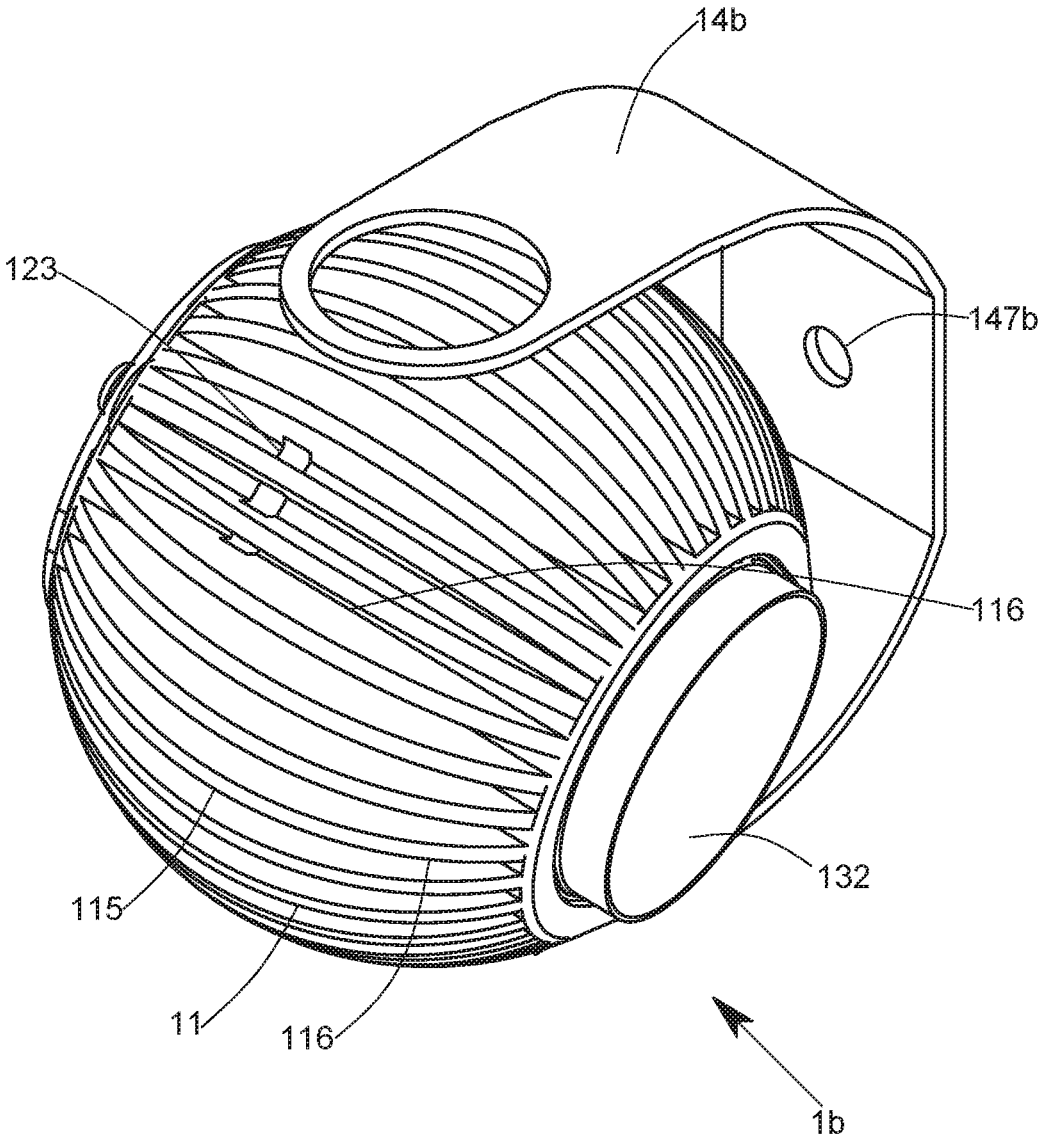
FIG. 7 is a perspective view showing a state in which a lighting fixture body of the lighting apparatus of FIG. 5 is rotated.

As shown in FIGS. 5 to 7, in a lighting apparatus 1*b* according to a second embodiment, a configuration of a lighting fixture body is the same as that of the lighting fixture body according to the first embodiment except for a light transmitting unit 161 and a support member 130*b* to be described later, and a configuration of a supporting tool 14*b* is different from that of the lighting apparatus 1 according to the first embodiment. In FIGS. 5 to 7, the same reference numerals as those used in FIGS. 1 to 4 are used for the members having the same configuration as the first embodiment.

[Supporting Tool]

In the second embodiment, as shown in FIGS. 5 and 6, the supporting tool 14*b* includes a first receiving portion 141*b*, a second receiving portion 142*b*, and an arm 143*b* for fixing the first receiving portion 141*b* and the second receiving portion 142*b*, and the arm 143*b* is shaped to support the spherical portion 116 of the lighting fixture body 11 by sandwiching the spherical portion 116 of the lighting fixture body 11 between the first receiving portion 141*b* and the second receiving portion 142*b*.

The arm 143*b* is formed of a metal plate which is a single rigid body in which the first receiving portion 141*b* and the second receiving portion 142*b* are provided on an inner side of a tip portion. The metal plate includes a first arm 144*b* and a second arm 145*b* which are disposed at intervals enough to enclose the spherical portion, and a base portion 146*b* connecting between an end portion of the first arm 144*b* and an end portion of the second arm 145*b*. A connection portion between the base portion 146*b* and the first arm 144*b* or the second arm 145*b* has a round shape. The arm 143*b* is configured in a U shape as a whole. The first receiving portion 141*b* and the second receiving portion 142*b* are each disposed inside the tip portions of the first arm 144*b* and the second arm 145*b*. A through hole 147*b* is disposed in the middle of the base portion 146*b*.

In the example of FIG. 6, the first receiving portion 141*b* and the second receiving portion 142*b* are formed of a through hole that is in sliding contact with the spherical portion 116. As shown in FIG. 6, the through hole is a circular hole penetrating through the first arm 144*b* or the second arm 145*b* and has a circular edge 149*b*. The circular edge 149*b* constitutes an annular portion 150*b*. Since the annular portion 150*b* is in linear contact with the spherical portion 116, it is possible to freely change the direction of the spherical portion 116 by making the spherical portion 116 slide against the annular portion 150*b* with a relatively small force. As a result, as shown in FIG. 7, the lighting fixture body 11 can be freely rotated with respect to the fixed supporting tool 14*b*.

[Lighting Fixture Body]

Hereinafter, only components different from the lighting apparatus 1 according to the first embodiment will be described below. In the lighting apparatus 1*b* according to the second embodiment, as the support member 130*b*, one formed by omitting the protrusion 131 is used. The reflecting mirror 112 and the lens 133 are omitted, and instead, the light transmitting unit 161 made of a transparent material such as glass or acrylic resin is used. The light transmitting unit 161 has a truncated cone shape, and its upper surface is positioned at a portion facing the LED element 111. A truncated conical recess is formed on the upper surface. Unevenness is formed on a bottom surface of the light transmitting unit 161, and the light transmitting unit 161 is configured to diffuse and project light incident on the light transmitting unit 161 from the LED element 111. It is to be noted that the upper surface of the truncated cone shape is a portion where a circle having an area smaller than the lower surface thereof is located and the lower surface of the truncated cone shape is a portion where a circle having an area larger than the upper surface thereof is located.

The light transmitting unit 161 has a flange-like protrusion 162 protruding in a direction intersecting an optical axis. A lower end portion of a cylindrical body 132 is configured to be in contact with the protrusion 162. By screwing the cylindrical body 132 with a screw portion provided on an inner circumferential surface of the support member 130*b*, the protrusion 162 of the light transmitting unit 161 is pressed at the lower end portion of the cylindrical body 132, so the light transmitting unit 161, the support member 130*b*, and the cylindrical body 132 are integrated.

Third Embodiment

Figure 8:
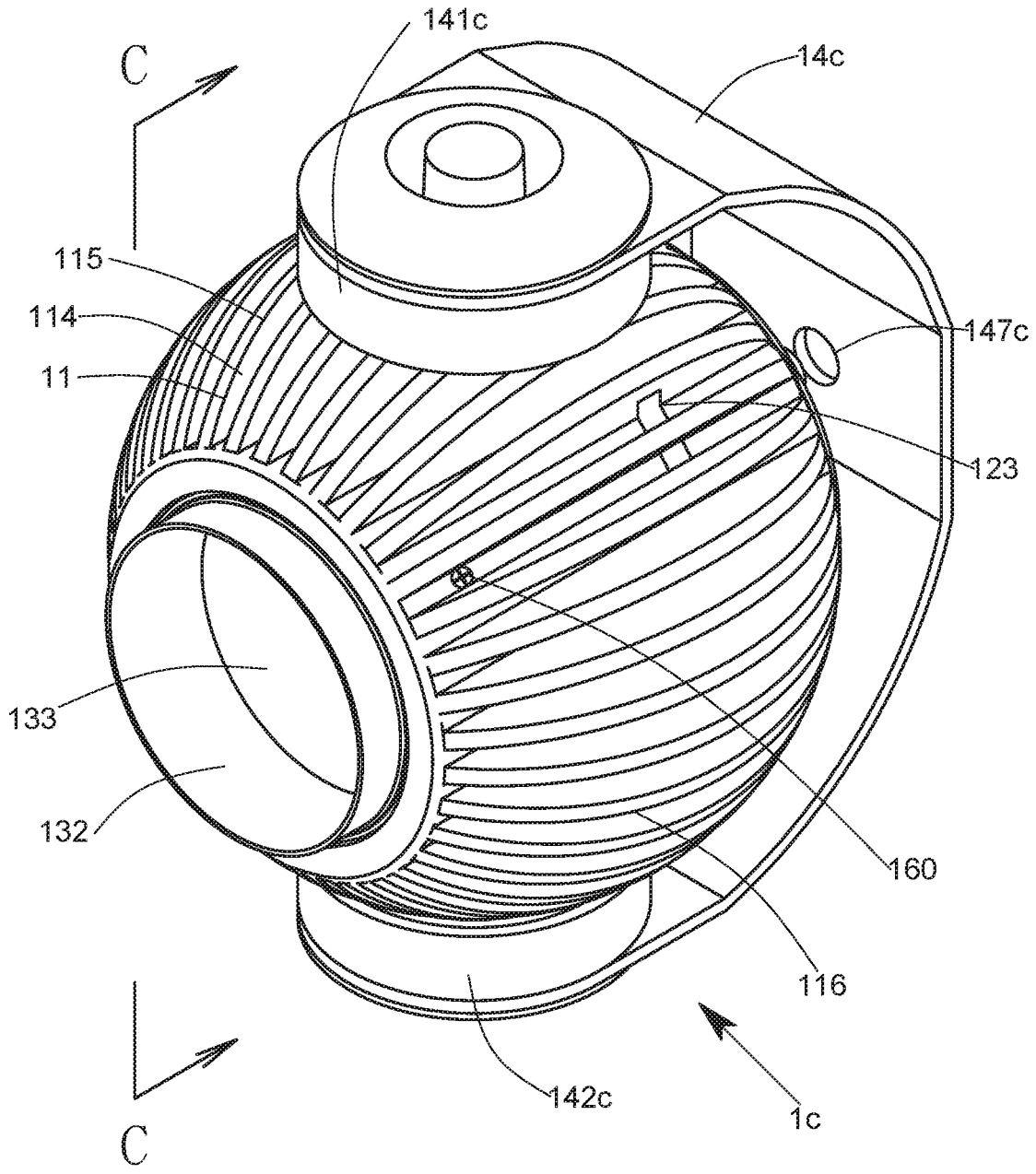
FIG. 8 is a perspective view showing a lighting apparatus according to a third embodiment.
Figure 9:
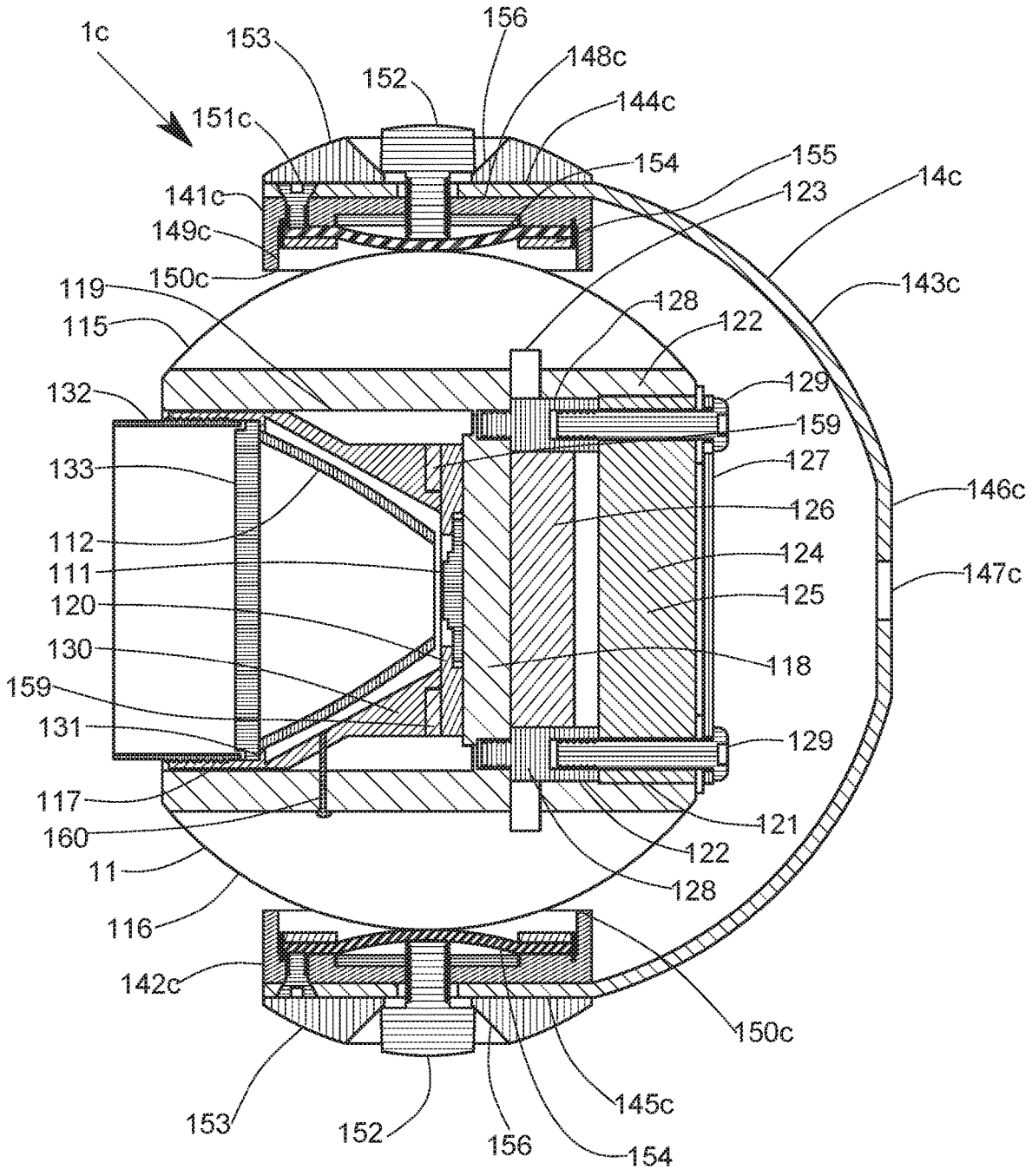
FIG. 9 is a cross-sectional view of a portion C in FIG. 8.
Figure 10:
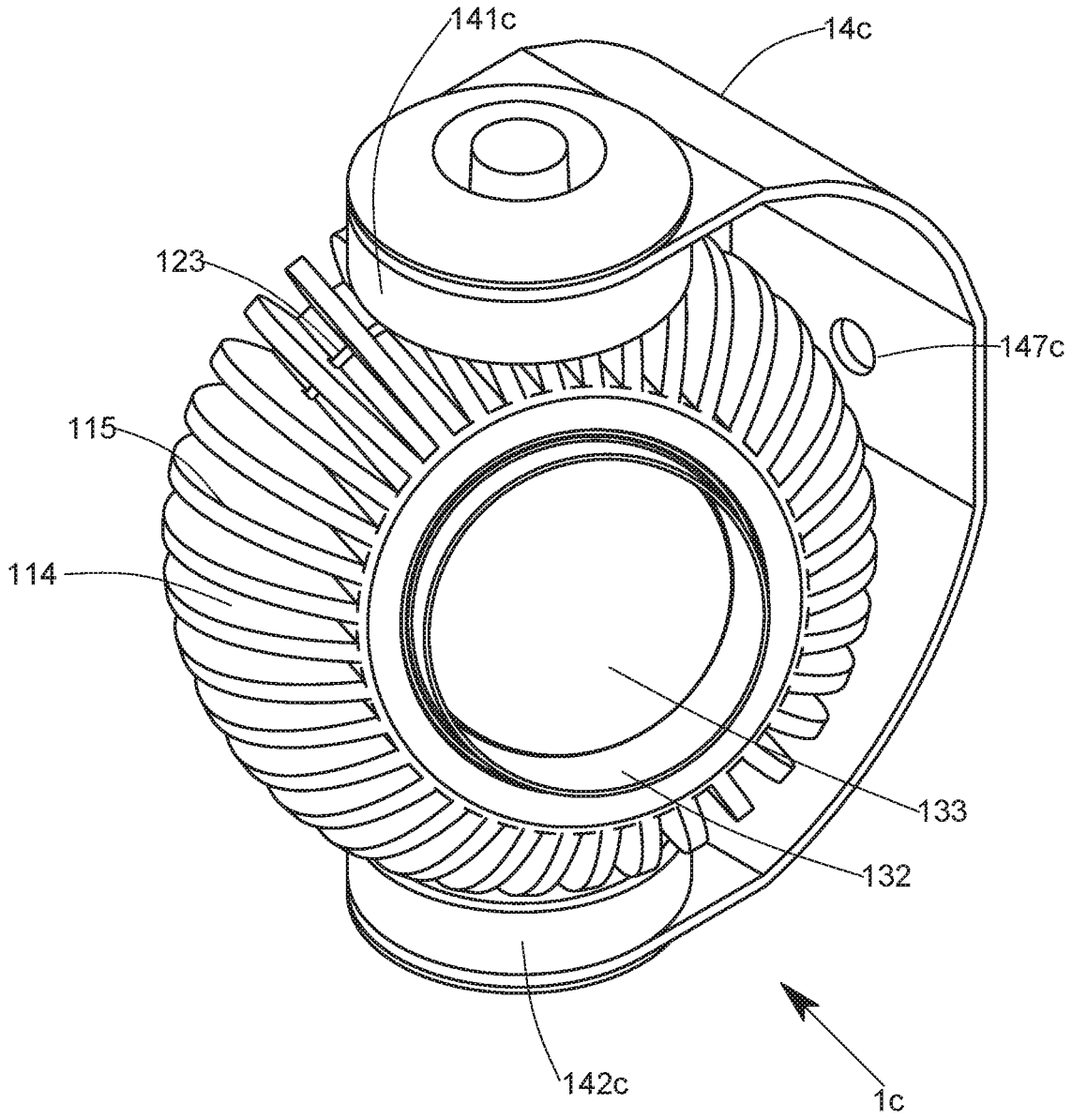
FIG. 10 is a perspective view showing a state in which a lighting fixture body of the lighting apparatus of FIG. 8 is rotated.

A basic configuration of a lighting apparatus 1*c* according to a third embodiment is the same as that of the lighting apparatus 1 according to the first embodiment, and the lighting apparatus 1*c* according to the third embodiment is different from the lighting apparatus 1 according to the first embodiment in that it has a mechanism capable of adjusting a force rotating a spherical portion. In FIGS. 8 to 10, the same reference numerals as those used in FIGS. 1 to 4 are used for the members having the same configuration as the first embodiment.

In the third embodiment, as shown in FIGS. 8 and 9, the supporting tool includes a first receiving portion 141*c*, a second receiving portion 142*c*, and an arm 143*c* for fixing the first receiving portion 141*c* and the second receiving portion 142*c*, and the arm 143*c* is shaped to support the spherical portion 116 of the lighting fixture body 11 by sandwiching the spherical portion 116 of the lighting fixture body 11 between the first receiving portion 141*c* and the second receiving portion 142*c*.

The arm 143*c* is formed of a metal plate which is a single rigid body in which the first receiving portion 141*c* and the second receiving portion 142*c* are provided on an inner side of a tip portion. The metal plate includes a first arm 144*c* and a second arm 145*c* which are disposed at intervals enough to enclose the spherical portion, and a base portion 146*c* connecting between an end portion of the first arm 144*c* and an end portion of the second arm 145*c*. A connection portion between the base portion 146*c* and the first arm 144*c* or the second arm 145*c* has a round shape. The arm 143*c* is configured in a U shape as a whole. The first receiving portion 141*c* and the second receiving portion 142*c* are each disposed inside the tip portions of the first arm 144*c* and the second arm. A through hole 147*c* is disposed in the middle of the base portion 146*c*.

The first receiving portion 141*c* and the second receiving portion 142*c* are formed of a cup which is in sliding contact with the spherical portion 116. As shown in FIG. 9, the cup has a base portion 148*c* made of a circular plate material and a circular edge 149*c* protruding from the base portion 148*c* toward the inner side of the arm 143*c*. The edge 149*c* of the cup is circular and constitutes an annular portion 150*c*. Since the annular portion 150*c* is in linear contact with the spherical portion 116, it is possible to freely change the direction of the spherical portion 116 by making the spherical portion 116 slide against the annular portion 150*c* with a relatively small force. As a result, as shown in FIG. 10, the lighting fixture body 11 can be freely rotated with respect to the fixed supporting tool 14*c*.

The first receiving portion 141*c* is made of plastic, and the first arm 144*c* and the base portion 148*c* are fixed by a plurality of screws 151*c* in a state in which the base portion 148*c* is in surface contact with the first arm 144*c*. The second receiving portion is also made of plastic, and the second arm 145*c* and the base portion 148*c* are fixed by the plurality of screws 151*c* in a state in which the base portion 148*c* is in surface contact with the second arm 145*c*.

As shown in FIG. 9, the first receiving portion 141*c* is provided with a screw 152 that can be displaced in a direction approaching or moving away from the spherical portion. By screwing the screw 152 so that the screw 152 approaches the spherical portion 116, a friction coefficient between the spherical portion 116 and the first receiving portion 141*c* is increased to be able to regulate the rotation of the spherical portion or make the rotation operation heavy. The friction coefficient between the spherical portion 116 and the first receiving portion 141*c* is decreased by retracting the screw 152 in the direction moving away from the spherical portion to be able to release the rotation regulation of the spherical portion or to make the rotation operation light. The second receiving portion 142*c* also has the screw 152, and the same effect is obtained by the same operation.

In the example of FIG. 9, a through hole is provided through a tip portion of the arm 143*c*, the first receiving portion 141*c*, and a regulating member 153 to be described below, respectively, for communicating them with each other, and the screw 152 is screwed to the through hole. A sheet-like cushioning material 154 and a fixture 155 for fixing the cushioning material 154 to the first receiving portion 141*c* are provided on the first receiving portion 141*c* to prevent scratches and the like due to the direct contact of the tip portion of the screw 152 with the spherical portion 116. The cushioning material is disposed to be in surface contact with the base portion 148*c* of the first receiving portion 141*c* so as to cover the tip portion of the screw 152. The fixture 155 is an annular body having a through hole provided at the center thereof, disposed so as to be in surface contact with the cushioning material 152, and fixed to the first receiving portion by a screw. The screw can be protruded from the through hole of the fixture 155. The cushioning material 152 is made of an elastic body such as rubber, and also functions to stop a slip. The second receiving portion 142*c* also has the same configuration.

The regulating member 153 is provided on the opposite side of the first receiving portion 141*c* and is fixed so as to be in surface contact with the tip portion of the arm. The regulating member has a through hole communicating with the through hole provided on the arm 143*c* provided in the middle thereof. The regulating portion 156 constituted by an inclined surface having a descending gradient toward the through hole is disposed on the whole circumference of the through hole. If the screw 152 is screwed, a lower end of the screw 152 is in contact with the regulating portion 156 to prevent the screw from being excessively screwed. This prevents the spherical portion from being damaged or the peripheral members of the first receiving portion 141*c* from being damaged. The second receiving portion 142*c* is also configured in the same manner and exerts the same effect. The shape of the regulating member 153 is not particularly limited, but in the example of FIG. 8, the regulating member 153 is a disc-shaped member.

What is claimed is:

1. A lighting apparatus, comprising:

a lighting fixture body having a light source; and a supporting tool for supporting the lighting fixture body, wherein the lighting fixture body has a spherical portion, the supporting tool includes a first receiving portion, a second receiving portion and an arm for fixing the first receiving portion and the second receiving portion, wherein at least one of the first receiving portion and the second receiving portion includes a cup with a circular base portion and a circular edge protruding from the base portion towards the spherical portion of the lighting fixture, the arm has a shape in which the spherical portion of the lighting fixture body is sandwiched and supported between the first receiving portion and the second receiving portion, and the spherical portion and the first receiving portion are not supported by a shaft and the spherical portion and the second receiving portion are not supported by the shaft.

2. The lighting apparatus according to claim 1, wherein a plurality of concave grooves is provided on a circumferential surface of the spherical portion of the lighting fixture body.

3. The lighting apparatus according to claim 1, wherein the first receiving portion or the second receiving portion is in sliding contact with the spherical portion of the lighting fixture body and rotatably supports the spherical portion.

4. The lighting apparatus according to claim 1, wherein the first receiving portion or the second receiving portion includes a screw that is displaced through the circular base portion in a direction approaching or moving away from the spherical portion to adjust a frictional resistance to the spherical portion.

* * * * *